US011732569B2

(12) United States Patent
AlSultan et al.

(10) Patent No.: US 11,732,569 B2
(45) Date of Patent: Aug. 22, 2023

(54) WELL TUBING/CASING CORROSION DEPOSITS DESCALING MODEL

(71) Applicant: SAUDI ARABIAN OIL COMPANY, Dhahran (SA)

(72) Inventors: Fuad A. AlSultan, Alahsa (SA); Abdulrahman T. Mishkhes, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 50 days.

(21) Appl. No.: 17/386,973

(22) Filed: Jul. 28, 2021

(65) Prior Publication Data

US 2023/0036144 A1 Feb. 2, 2023

(51) Int. Cl.

| | |
|---|---|
| ***E21B 37/06*** | (2006.01) |
| ***E21B 47/06*** | (2012.01) |
| ***E21B 47/00*** | (2012.01) |
| ***E21B 41/02*** | (2006.01) |

(52) U.S. Cl.

CPC ..... *E21B 47/006* (2020.05); *E21B 37/06* (2013.01); *E21B 41/02* (2013.01); *E21B 47/06* (2013.01); *E21B 2200/20* (2020.05)

(58) Field of Classification Search

CPC ..... E21B 47/006; E21B 47/00; E21B 37/06; E21B 47/06; E21B 2200/20; E21B 33/00

See application file for complete search history.

(56) References Cited

U.S. PATENT DOCUMENTS

| | | | | |
|---|---|---|---|---|
| 7,357,179 | B2 * | 4/2008 | Zheng | E21B 41/00 166/250.01 |
| 8,447,529 | B2 * | 5/2013 | Hernandez | F17D 5/00 205/777 |
| 9,297,767 | B2 * | 3/2016 | Maida, Jr. | G01N 21/7703 |
| 10,443,376 | B2 * | 10/2019 | Teale | E21B 49/00 |

(Continued)

FOREIGN PATENT DOCUMENTS

| | | | |
|---|---|---|---|
| CN | 201818281 | U | 5/2011 |
| WO | 2020/231442 | A1 | 11/2020 |

OTHER PUBLICATIONS

Al-Dhafeeri, Abdullah M. et al., "An Effectiveness Descaling Production Tubing Utilizing a Torque Action Debris Breaker TADB to Restore Wellbore Accessibility in Offshore Oil Wells"; Proceedings of the Abu Dhabi International Petroleum Exhibition & Conference; Paper No. SPE-203113-MS; pp. 1-10; Nov. 9-12, 2020 (10 pages).

(Continued)

*Primary Examiner* — Catherine Loikith

(74) *Attorney, Agent, or Firm* — Osha Bergman Watanabe & Burton LLP

(57) ABSTRACT

A method for performing a maintenance operation of a well in an oil/gas field. The method includes identifying an extent of corrosion deposit of the well, predicting, using a descaling model of the oil/gas field and based on the extent of corrosion deposit, expected descaling metal loss in a tubular of the well, calculating, based on the expected descaling metal loss, a tubular burst/collapse pressure for a predicted thickness of the tubular, comparing the tubular burst/collapse pressure against a well operating pressure to generate a comparison result, and performing the maintenance operation of the well based on the comparison result.

20 Claims, 7 Drawing Sheets

(56) References Cited

U.S. PATENT DOCUMENTS

| | | | | |
|---|---|---|---|---|
| 10,570,703 | B2 * | 2/2020 | Samuel | E21B 12/02 |
| 2016/0320769 | A1 * | 11/2016 | Deffenbaugh | E21B 47/06 |
| 2017/0038493 | A1 | 2/2017 | Wu et al. | |
| 2017/0227451 | A1 * | 8/2017 | Hoegerl | G01N 17/04 |
| 2020/0141225 | A1 | 5/2020 | Aniket et al. | |
| 2022/0156656 | A1 * | 5/2022 | Dighe | G06Q 10/0635 |

OTHER PUBLICATIONS

Shakeel, Muzzammil et al., "Scale Removal in Tubulars using Jetting Technique: A Novel Laboratory Approach"; Proceedings of the SPE Kuwait Oil & Gas Show and Conference; Paper No. SPE-187590-MS; pp. 1-10; Oct. 15-18, 2017 (10 pages).

* cited by examiner

WELL TUBING/CASING CORROSION DEPOSITS DESCALING MODEL

BACKGROUND

In the oil/gas industry, scale is a common issue that creates obstruction in wellbore tubulars, restricts the flow of the wells, and causes major well integrity problems. Scale may be caused by salt or other chemicals/impurities in the fluid flow over the internal surface of the tubular. The internal surface of the tubular may also be corroded by the salt or other chemicals/impurities to form corrosion deposits on the internal surface of the tubular. Once scale is found in a well, the oil/gas operator company may perform a chemical or mechanical de-scaling operation, or perform well workover using a rig to replace the well tubing with a new one.

SUMMARY

In general, in one aspect, the invention relates to a method for performing a maintenance operation of a well in an oil/gas field. The method includes identifying an extent of corrosion deposit of the well, predicting, using a descaling model of the oil/gas field and based on the extent of corrosion deposit, expected descaling metal loss in a tubular of the well, calculating, based on the expected descaling metal loss, a tubular burst/collapse pressure for a predicted thickness of the tubular, comparing the tubular burst/collapse pressure against a well operating pressure to generate a comparison result, and performing the maintenance operation of the well based on the comparison result.

In general, in one aspect, the invention relates to a system for performing a maintenance operation of a well in an oil/gas field. The system includes a well control system for performing well maintenance operations of the well, and a well maintenance management system that includes a tubular profiling engine configured to identify an extent of corrosion deposit of the well, a descaling modeling engine configured to generate a descaling model based on a reference well in the oil/gas field, and predict, using the descaling model and based on the extent of corrosion deposit, expected descaling metal loss in a tubular of the well, and a descaling management engine configured to calculate, based on the expected descaling metal loss, a tubular burst/collapse pressure for a predicted thickness of the tubular, compare the tubular burst/collapse pressure against a well operating pressure to generate a comparison result, and facilitate, based on the comparison result, performing the maintenance operations of the well by the well control system.

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of this disclosure provide a method to generate a descaling model of an oil/gas field and utilize the descaling model to select an optimum treatment approach of a well with corrosion deposit issues. The well with corrosion deposit issues needing treatment is referred to as a target well. In one or more embodiments, the descaling model is generated by correlating a post-treatment tubular profile and a pre-treatment tubular profile of a reference well. The correlation includes generating a trend between corrosion deposit build up and tubular metal loss in the tubular profiles. To select the optimum treatment plan of the target well, the descaling model is used to predict, based on the extent of corrosion deposit in a tubular of the target well, expected descaling metal loss in the tubular. A tubular burst/collapse pressure for the predicted post-treatment thickness of the tubular is then calculated based on the expected descaling metal loss.

Accordingly, the optimum treatment plan is determined based on a comparison between the tubular burst/collapse pressure against a well operating pressure of the target well. If the tubular burst/collapse pressure exceeds a maximum well operating pressure, the chemical and/or mechanical descaling operation is selected as the optimum treatment plan. Conversely, if the tubular burst/collapse pressure is less than the maximum well operating pressure, the rig workover to replace the tubular is selected as the optimum treatment plan.

Figure 1A:
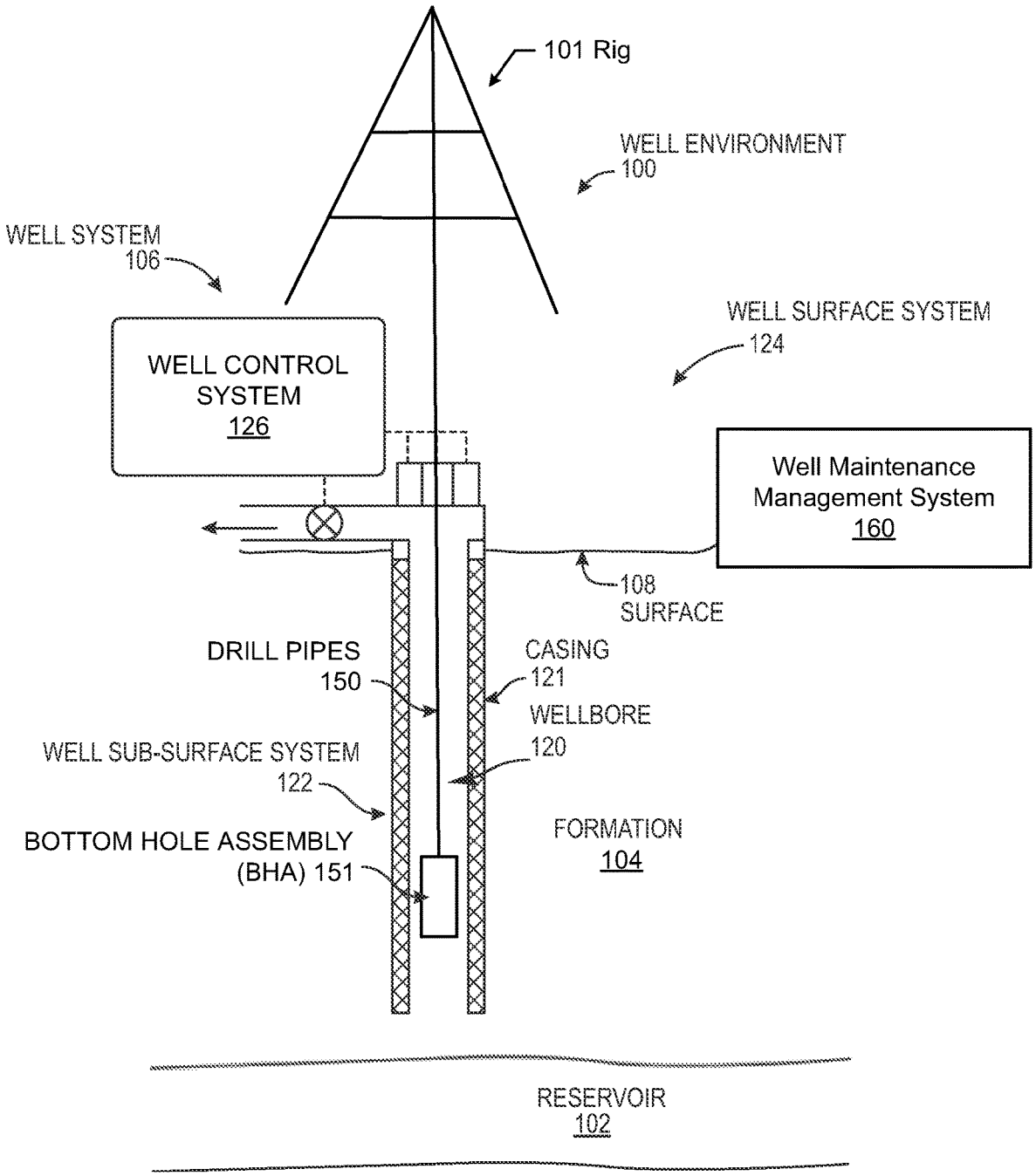
FIGS. 1A and 1B show systems in accordance with one or more embodiments.

FIG. 1A shows a schematic diagram in accordance with one or more embodiments. As shown in FIG. 1A, a well environment (100) includes a subterranean formation ("formation") (104) and a well system (106). The formation (104) may include a porous or fractured rock formation that resides underground, beneath the earth's surface ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102). In the case of the well system (106) being operated as a production well, the well system (106)

may facilitate the extraction of hydrocarbons (or "production") from the reservoir (102). The hydrocarbons may be in the form of oil and/or gas.

In some embodiments disclosed herein, the well system (106) includes a rig (101), a wellbore (120) with a casing (121), a well sub-surface system (122), a well surface system (124), and a well control system ("control system") (126). The well control system (126) may control various operations of the well system (106), such as well production operations, well drilling operation, well completion operations, well maintenance operations, and reservoir monitoring, assessment and development operations. For example, the well maintenance operations may include descaling operations in the wellbore (120).

The rig (101) is the machine used to drill a borehole to form the wellbore (120). Major components of the rig (101) include the drilling fluid tanks, the drilling fluid pumps (e.g., rig mixing pumps), the derrick or mast, the draw works, the rotary table or top drive, the drill string, the power generation equipment and auxiliary equipment. Drilling fluid, also referred to as "drilling mud" or simply "mud," is used to facilitate drilling boreholes into the earth, such as drilling oil and natural gas wells. The main functions of drilling fluids include providing hydrostatic pressure to prevent formation fluids from entering into the borehole, keeping the drill bit cool and clean during drilling, carrying out drill cuttings, and suspending the drill cuttings while drilling is paused and when the drilling assembly is brought in and out of the borehole.

The wellbore (120) includes a bored hole (i.e., borehole) that extends from the surface (108) towards a target zone of the formation (104), such as the reservoir (102). An upper end of the wellbore (120), terminating at or near the surface (108), may be referred to as the "up-hole" end of the wellbore (120), and a lower end of the wellbore, terminating in the formation (104), may be referred to as the "downhole" end of the wellbore (120). The wellbore (120) may facilitate the circulation of drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the hydrocarbon-bearing formation (104) or the reservoir (102) during injection operations, or facilitate the communication of monitoring devices (e.g., logging tools) lowered into the formation (104) or the reservoir (102) during monitoring operations (e.g., during in situ logging operations).

In some embodiments, the well system (106) is provided with a bottom hole assembly (BHA) (151) attached to drill pipes (150) to suspend into the wellbore (120) for performing the well drilling operation. The bottom hole assembly (BHA) is the lowest part of a drill string and includes the drill bit, drill collar, stabilizer, mud motor, etc. The well system (106) may also be provided with slickline, wireline, coiled tubing, downhole equipment such as valves, pumps, pressure/temperature/flow sensors, and other completion equipment of the casing (121).

In some embodiments, the well system (106) is further provided with a well maintenance management system (160). For example, the well maintenance management system (160) may include hardware and/or software with functionality to manage or otherwise facilitate well maintenance operations, such as a wellbore descaling operation, a wellbore workover operation, etc. In some embodiments, the well maintenance management system (160) includes a computer system, such as a portion of the computing system described in reference to FIGS. 4A-4B below.

While the well maintenance management system (160) is shown at a well site in FIG. 1A, those skilled in the art will appreciate that the well maintenance management system (160) may also be remotely located away from well site.

Figure 1B:
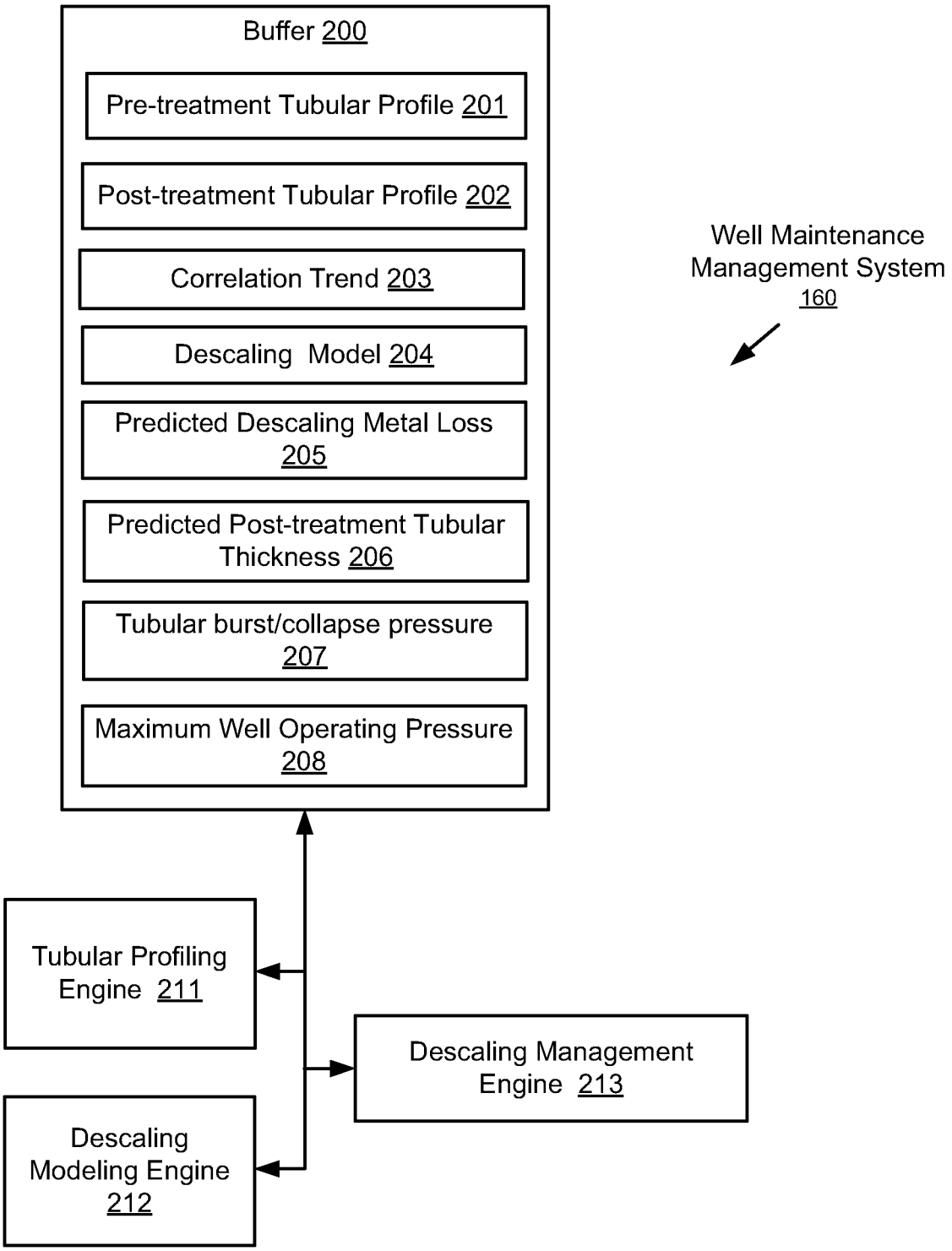

Turning to FIG. 1B, FIG. 1B illustrates a portion of the well maintenance management system (160) depicted in FIG. 1A above. In one or more embodiments, one or more of the modules and/or elements shown in FIG. 1B may be omitted, repeated, combined and/or substituted. Accordingly, embodiments disclosed herein should not be considered limited to the specific arrangements of modules and/or elements shown in FIG. 1B.

Figure 4A:
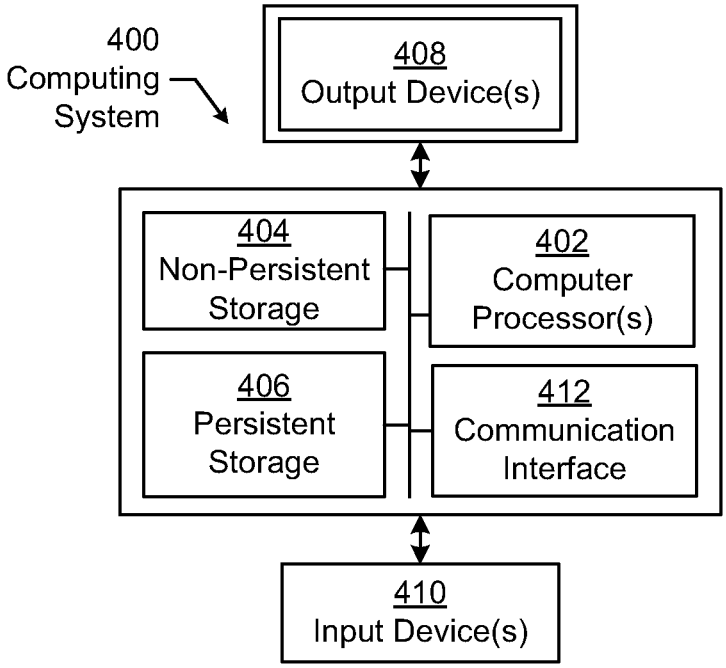
FIGS. 4A and 4B show a computing system in accordance with one or more embodiments.
Figure 4B:
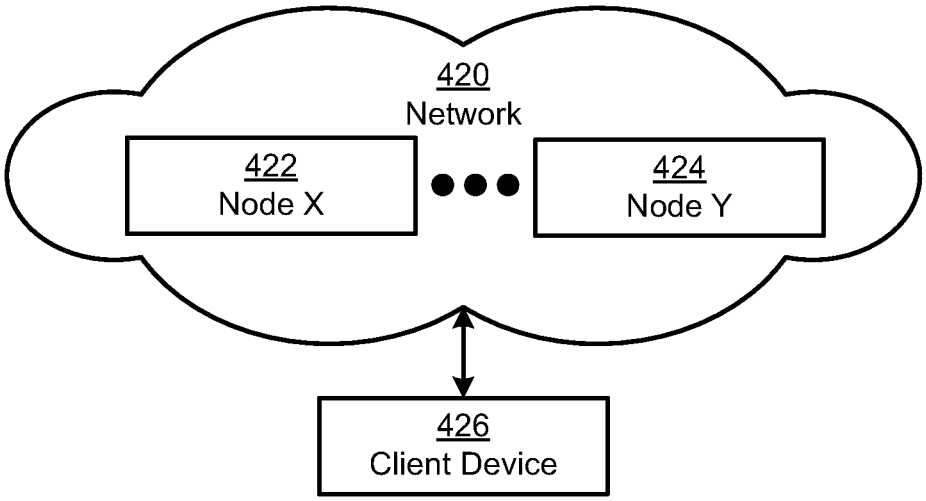

As shown in FIG. 1B, FIG. 1B illustrates the well maintenance management system (160) that has multiple components. For example, the well maintenance management system (160) has a buffer (200), a tubular profiling engine (211), a descaling modeling engine (212), and a descaling management engine (213). Each of these components (211, 212, 213) may be located on the same computing device (e.g., personal computer (PC), laptop, tablet PC, smart phone, multifunction printer, kiosk, server, etc.) or on different computing devices that are connected via a network, such as a wide area network or a portion of Internet of any size having wired and/or wireless segments. The computing device(s) may be such as shown in FIGS. 4A-4B. Each of these components is discussed below.

In one or more embodiments, the buffer (200) may be implemented in hardware (i.e., circuitry), software, or any combination thereof. The buffer (200) is configured to store data generated and/or used by the well maintenance management system (160). The data stored in the buffer (200) includes the pre-treatment profile (201), the post-treatment profile (202), the correlation trend (203), the descaling model (204), the predicted descaling metal loss (205), the predicated post-treatment tubular thickness (206), the tubular burst/collapse pressure (207), and the maximum well operating pressure (208).

The pre-treatment profile (201) is a sequence of tubular internal diameters (IDs), measured prior to a descaling operation, with respect to corresponding longitudinal distances (e.g., depth) along the wellbore. The measured tubular IDs, as recorded in the pre-treatment profile (201), are smaller than the original ID of the tubular wherever corrosion deposit build up are present at the internal surface of the tubular.

The post-treatment profile (202) is a sequence of tubular IDs, measured subsequent to a descaling operation, with respect to corresponding longitudinal distances (e.g., depth) along the wellbore. The measured tubular IDs, as recorded in the post-treatment profile (202), are larger than the original ID of the tubular where corrosion deposit build up are removed from the internal surface of the tubular to expose areas of metal loss.

The correlation trend (203) is the mathematical relationship between the percentage corrosion deposit build up and the percentage metal loss that is established over a range of longitudinal distances (e.g., depth) along the wellbore. The percentage corrosion deposit build up is the percentage difference between the original tubular ID and the measured tubular ID as recorded in the pre-treatment profile (201). In other words, the percentage corrosion deposit buildup corresponds to the quotient of dividing the difference between the original tubular ID and the measured tubular ID as recorded in the pre-treatment profile (201) by the original tubular ID. The percentage metal loss is the percentage difference between the original tubular ID and the measured tubular ID as recorded in the post-treatment profile (202). In other words, the percentage metal loss corresponds to the quotient of dividing the difference between the original tubular ID and the measured tubular ID as recorded in the post-treatment profile (202) by the original tubular ID.

The descaling model (204) is a formulated or otherwise derived version of the correlation trend (203). While the correlation trend (203) may be tabulated based on measured tubular IDs retrieved directly from the pre-treatment profile (201) and the post-treatment profile (202), the descaling model (204) is formulated to receive an input and generate a corresponding output based on the mathematical relationship conveyed in the correlation trend (203). Specifically, the percentage corrosion deposit buildup derived from the pre-treatment tubular profile (201) of the target well is used as input to the descaling model (204) to generate the predicted descaling metal loss (205) at a corresponding location in the tubular of the target well.

The predicted descaling metal loss (205) is the predicted percentage metal loss at a particular location in the tubular prior to any descaling operation that may expose an actual metal loss. In one or more embodiments, the tubular metal loss thickness is predicted by subtracting the original tubular ID of the tubular from the post-treatment tubular ID to calculate a percentage difference.

The predicated post-treatment tubular thickness (206) is the predicted remaining tubular thickness at a particular location in the tubular after a descaling operation is performed to remove corrosion deposit buildup and expose an actual metal loss at the particular location. In one or more embodiments, the post-treatment tubular thickness is predicted by subtracting the predicted descaling metal loss of the tubular from the original tubular thickness.

The tubular burst/collapse pressure (207) is a rating of the tubular metal material at a particular thickness. The tubular having the particular thickness is expected to burst/collapse when the internal surface of the tubular is subjected to a pressure exceeding this rating. For example, a tubing with a 4.5 inch outside diameter (OD) (non-upset) with Grade J-55 and a 3.833 inch inside diameter (ID) has a collapse resistance of 5,720 psi and an internal yield of 5,790 psi.

The maximum well operating pressure (208) is the maximum pressure that can be applied to the internal surface of the tubular during various operations of the well such as well production operations. For instance, for a well completed with 15K wellhead assembly and 4.5 inch J-55 OD tubing, the differential pressure across the tubing must not exceed the collapse limit of 5720 psi or the burst limit of 5790 psi.

In one or more embodiments, each of the tubular profiling engine (211), descaling modeling engine (212), and descaling management engine (213) may be implemented in hardware (i.e., circuitry), software, firmware or any combination thereof.

In one or more embodiments, the tubular profiling engine (211) performs tubular ID profiling of various wells in an oil/gas field. In particular, the tubular profiling engine (211) generates the pre-treatment profile (201) and the post-treatment profile (202) for one or more reference wells and one or more target wells.

In one or more embodiments, the descaling modeling engine (212) performs the descaling model generation based on the pre-treatment profile (201) and the post-treatment profile (202) of the reference well. In addition, the descaling modeling engine (212) performs the descaling model utilization for the target well. In particular, the descaling modeling engine (212) generates the predicted descaling metal loss (205) and the predicted post-treatment tubular thickness (206) at various locations in the target well based on the pre-treatment profile (201) of the target well.

In one or more embodiments, the descaling management engine (213) performs the descaling management of the target well that includes calculating the tubular burst/collapse pressure (207) for the predicted post-treatment tubular thickness (206) based on the predicted descaling metal loss (205), and comparing the tubular burst/collapse pressure (207) against the maximum well operating pressure (208) to determine the optimum treatment plan for the target well. The optimum treatment plan is then provided to the well control system (126) to facilitate performing the well maintenance operation. For example, the optimum treatment plan may correspond to a chemical descaling operation, a mechanical descaling operation, or a well workover operation that is to be performed by the well control system (126).

In one or more embodiments, the well maintenance management system (160) performs the functionalities described above using the method described in reference to FIGS. 2A and 2B below. Although the well maintenance management system (160) is shown as having three engines (211, 212, 213), in other embodiments of the invention, the well maintenance management system (160) may have more or fewer engines and/or more or fewer other components. Further, the functionality of each component described above may be split across components or combined into a single, more robust component. Further still, each component (211, 212, 213) may be utilized multiple times to carry out an iterative operation.

Figure 2A:
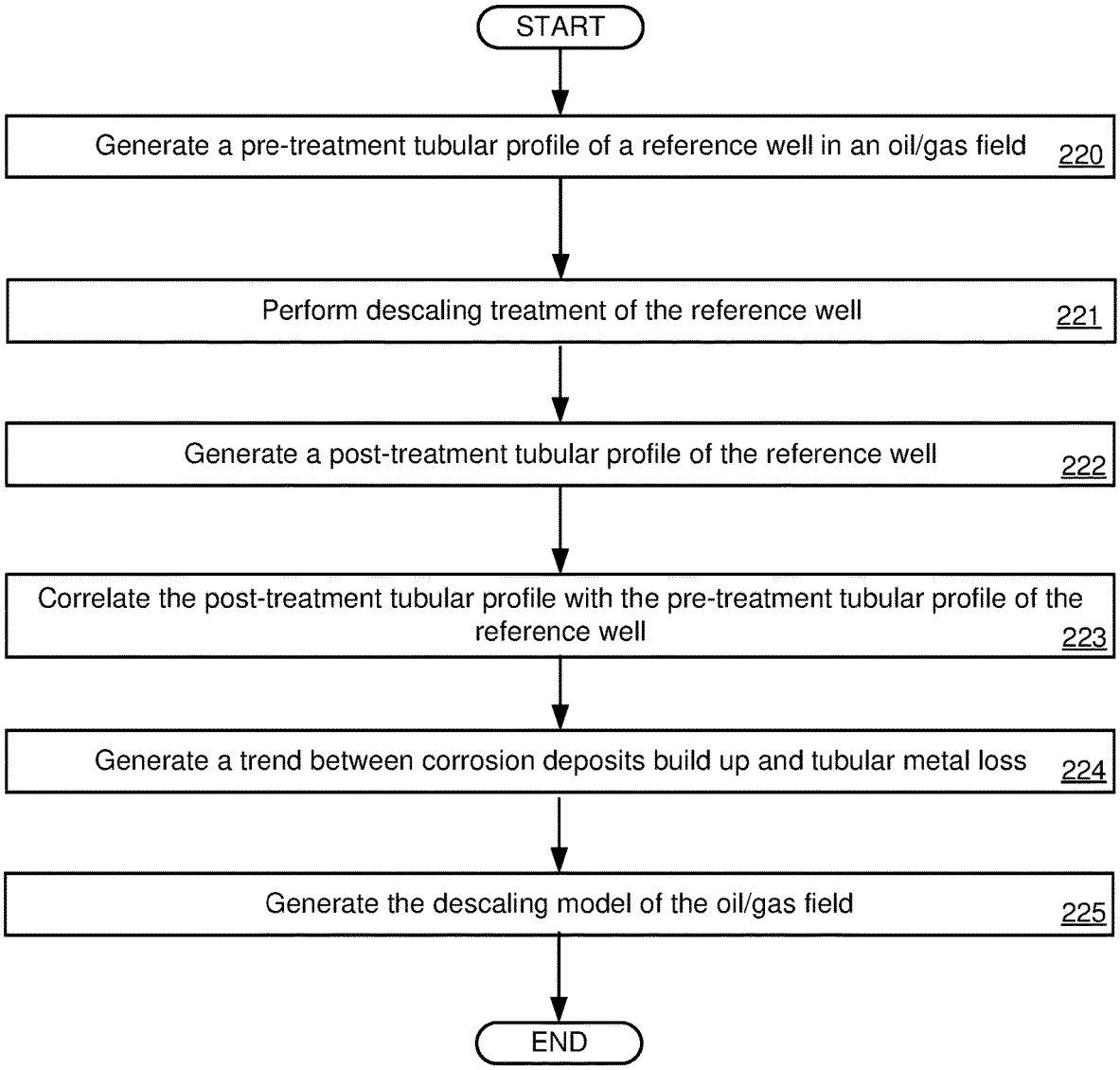
FIGS. 2A and 2B show method flowcharts in accordance with one or more embodiments.
Figure 2B:
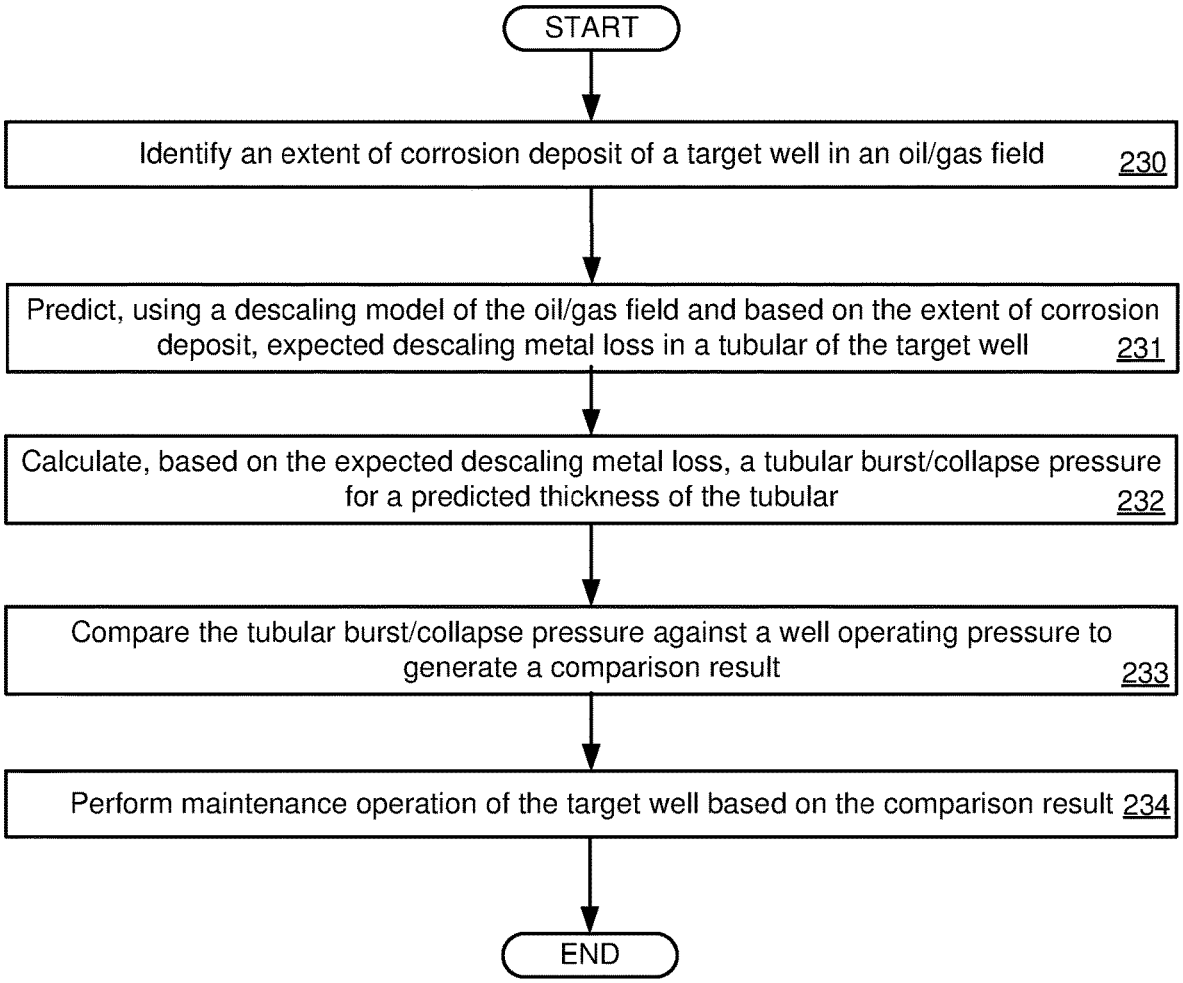

Turning to FIGS. 2A and 2B, FIGS. 2A and 2B show method flowcharts in accordance with one or more embodiments. One or more blocks in FIGS. 2A and 2B may be performed using one or more components as described in FIGS. 1A and 1B. While the various blocks in FIGS. 2A and 2B are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

FIG. 2A shows the method flowchart to generate a descaling model for an oil/gas field. Initially in Block 220, a pre-treatment tubular profile of a reference well in the oil/gas field is generated. Specifically, the pre-treatment tubular profile records pre-treatment tubular IDs measured as a function of longitudinal distance (e.g., depth) along the wellbore. In one or more embodiments of the invention, the pre-treatment tubular ID profile is measured using a gauge cutter lowered into the wellbore.

In Block 221, a descaling treatment of the reference well is performed. For example, a chemical and/or mechanical descaling treatment is applied to the reference well to remove the corrosion deposits from the internal surface of the tubular.

In Block 222, a post-treatment tubular profile of the reference well is generated. Specifically, the post-treatment tubular ID profile records post-treatment tubular IDs measured as a function of longitudinal distance (e.g., depth) along the wellbore. In one or more embodiments of the invention, the post-treatment tubular ID profile is measured using a gauge cutter lowered into the wellbore.

In Block 223, the post-treatment tubular profile is correlated with the pre-treatment tubular profile of the reference well. Specifically, the pre-treatment tubular ID and the post-treatment tubular ID at the same longitudinal distance (e.g., depth) are compared throughout the longitudinal distance (e.g., depth) range of the wellbore.

In Block 224, a trend between corrosion deposit build up and tubular metal loss is generated based on the correlation. In one or more embodiments of the invention, the pre-treatment tubular ID is subtracted from the original tubular ID of the reference well to calculate the corrosion deposit build up thickness. In addition, the original tubular ID of the reference well is subtracted from the post-treatment tubular ID to calculate the tubular metal loss thickness. In one or more embodiments, the trend is a plotted curve of the percentage corrosion deposit build up versus the percentage tubular metal loss.

In Block 225, the descaling model of the oil/gas field is generated. In one or more embodiments of the invention, the descaling model is generated by applying a best-fit algorithm to the series of data points of the plotted curve to derive a mathematical function that represents the trend between the percentage corrosion deposit build up and the percentage tubular metal loss in the reference well. In one or more embodiments, the descaling model is used to facilitate determining the optimum approach to perform a maintenance operation of a target well in the same oil/gas field as the reference well.

FIG. 2B shows the method flowchart to perform a maintenance operation of a target well utilizing a descaling model for the oil/gas field. Initially in Block 230, an extent of corrosion deposit of the target well is identified. In one or more embodiments of the invention, the pre-treatment tubular ID profile of the target well is measured using a gauge cutter lowered into the wellbore. The corrosion deposit is then calculated by subtracting the measured tubular ID from the original tubular ID of the target well. Further, the extent of the corrosion deposit is calculated by dividing the corrosion deposit build up over the original tubular ID of the target well and expressed in the percentage form.

In Block 231, an expected descaling metal loss in a tubular of the target well is predicted using a descaling model of the oil/gas field and based on the extent of corrosion deposit. In one or more embodiments of the invention, the extent of corrosion deposit is used as an input to the descaling model to generate the expected descaling metal loss in the tubular. The descaling model outputted expected descaling metal loss in percentage form is multiplied by the original tubular ID of the target well to calculate the actual thickness of the expected descaling metal loss.

In Block 232, based on the expected descaling metal loss, a tubular burst/collapse pressure is calculated for a predicted thickness of the tubular. The predicted thickness of the tubular is calculated by subtracting the actual thickness of the expected descaling metal loss from the original thickness of the tubular of the target well. The tubular burst/collapse pressure is calculated based on empirical characteristics pre-compiled for the particular material (e.g., steel, iron, etc.) of the tubular.

In Block 233, the tubular burst/collapse pressure is compared against a maximum well operating pressure to generate a comparison result. The maximum well operating pressure is a pre-determined parameter in the technical specification of the well completion of the target well.

In Block 234, the maintenance operation of the target well is performed based on the comparison result. In one or more embodiments of the invention, in response to determining that the tubular burst/collapse pressure is larger than the maximum well operating pressure, the chemical and/or mechanical descaling operation is selected as the optimum approach of the maintenance operation. Otherwise, in response to determining that the tubular burst/collapse pressure is less than the maximum well operating pressure, the rig workover operation to replace the corroded tubular is selected as the optimum approach of the maintenance operation.

Figure 3A:
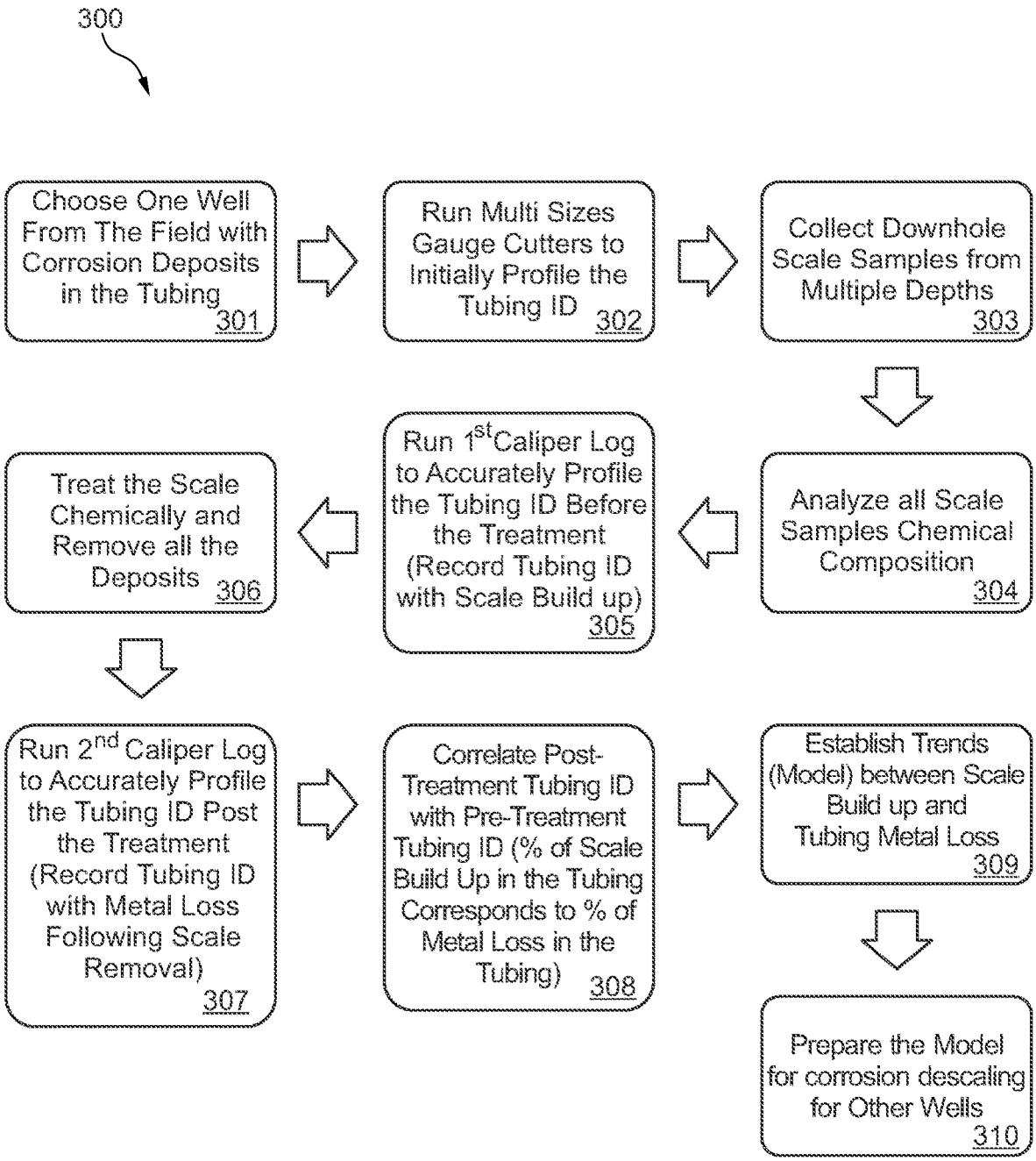
FIGS. 3A and 3B show an example in accordance with one or more embodiments.
Figure 3B:
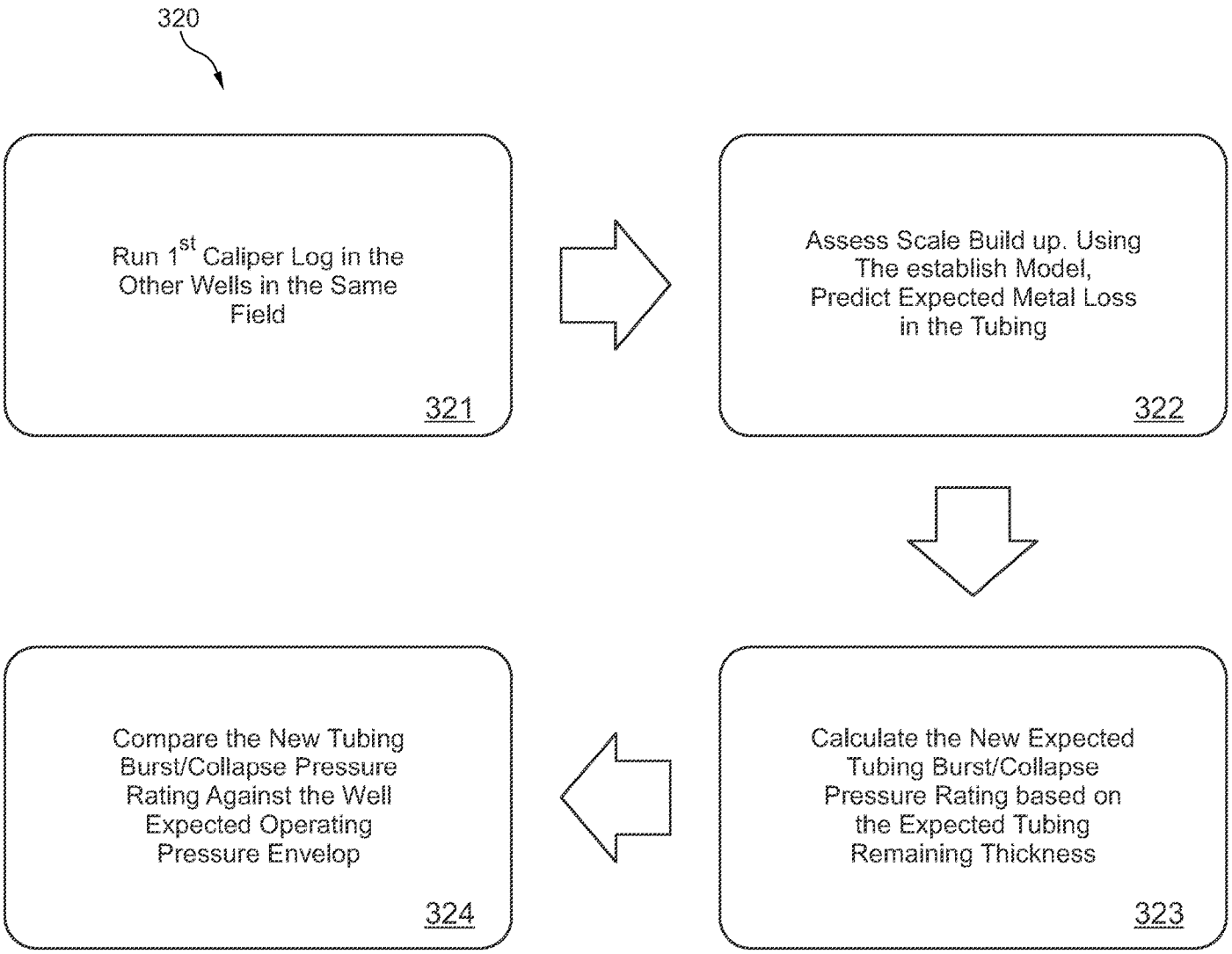

FIGS. 3A-3B show an example in accordance with one or more embodiments. The example shown in FIGS. 3A-3B is based on the system and method described in reference to FIGS. 1A-1B and 2A-2B above. One or more of the modules and/or elements shown in FIGS. 3A-3B may be omitted, repeated, combined and/or substituted.

The example shown in FIGS. 3A-3B illustrates a descaling modeling methodology that is developed from a selected reference well in a specific oil/gas field. In particular, a descaling model is generated based on de-rating values of the well tubulars of the reference well following removal of the corrosion deposits in the reference well. A decision criteria based on the descaling modeling methodology is then utilized across the specific oil/gas field to effectively and economically treat target wells with casing/tubing corrosion deposits. The descaling modeling methodology includes a model building phase and a model utilization phase.

FIG. 3A shows an example block diagram (300) of the model building phase of the descaling modeling methodology. Initially in Block 301, an oil company operator selects a reference well from the oil/gas field that is identified with corrosion deposits in the tubing and requires treatment to eliminate any production or well accessibility issues.

In Block 301, the operator selects a well in the specific oil/gas field as a reference well for the descaling modeling methodology.

In Block 302, the operator runs multi-size gauge cutters (GCs) to initially profile the tubing internal diameter (ID) in the reference well. The corrosion deposits are detected wherever the tubing ID measured using the GCs is less than the original tubing ID by a pre-determined threshold (e.g., 1" difference).

In block 303, the operator collects downhole corrosion deposits samples from multiple depths in the tubing of the reference well. For example, each corrosion deposit sample may be retrieved from a particular depth using the gauge cutter.

In Block 304, the collected samples are analyzed for their chemical compositions. For example, the type of chemicals to use in a chemical descaling operation may be selected based on the identified chemical compositions. In another example, the type of mechanical device to use in a mechanical descaling operation may be selected based on the identified chemical compositions.

In Block 305, the operator runs a first caliper log (multi-finger mechanical log) of the reference well to accurately profile the tubing ID before the chemical treatment of the corrosion deposits. In some section of the wellbore, the recorded tubing ID in the first caliper log may be smaller than the original tubing ID due to the corrosion deposit.

In Block 306, the chemical treatment is performed with either acid solvent or brine based chemical dissolver to remove all the foreign deposits in the tubing of the reference well. Alternatively or in combination, a mechanical scrubbing treatment may be performed for removing the foreign deposits.

In Block 307, the operator runs a second caliper log of the reference well to accurately profile the tubing ID post the chemical treatment. In particular, the metal loss is measured following the deposits removal. For example, the metal loss may be represented as the percentage difference between the original tubing ID and the recorded ID in the second caliper log.

In Block 308, the post-treatment tubing IDs are correlated with pre-treatment tubing IDs. Specifically, percentage deposits build up derived from the first caliper log and corresponding percentage metal loss derived from the second caliper log at each depth are combined into a single data point of a trend curve or a single entry of a look up table.

In Block 309, trends (models) are established between corrosion deposit build up and tubing metal loss. For example, the trends may be represented by a trend curve of plotting the percentage deposits build up versus the percentage metal loss in the tubing.

In Block 310, the descaling model for corrosion descaling is prepared for the other wells in the same oil/gas field completed with similar completions. For example, the descaling model may be in the form of an analytical mathematical function, a look up table, a data plot, or other suitable format. Further, the descaling model may be generated by applying a mathematical smoothing function to the trend curve established in Block 309 above.

Once the model building phase is completed as shown in the diagram (300), the descaling model is ready to be utilized for other wells in the same oil/gas field. When target wells are identified as having corrosion deposits, the operator is notified to proceed to the model utilization phase of the descaling modeling methodology. Specifically, the descaling modeling methodology aids the operator to arrive at an economical decision on the future remedy actions of these target wells identified with corrosion deposits.

While the de-scaling operation is a cheaper alternative, the de-scaling operation may lead to major damage to the well tubing if the well already has extensive metal loss. In such case, the descaling modeling methodology may lead the operator to decide that the rig workover is more cost effective to address the corrosive deposits issue of the target well.

FIG. 3B shows an example block diagram (320) of the model utilization phase of the descaling modeling methodology. Initially in Block 321, the operator runs a first caliper log of a target well to evaluate the extent of the corrosion deposits.

In Block 322, the corrosion deposit build up is assessed and a percentage corrosion deposit build up is calculated. The descaling model established according to the block diagram (300) above is utilized to predict the expected metal loss in the tubing. For example, the calculated percentage corrosion deposit build up is used as an input to the descaling model (e.g., an analytical mathematical function, a look up table, a data plot, etc.) to look up the descaling model output as the expected metal loss in the tubing.

In Block 323, the expected tubing burst/collapse pressure rating is calculated based on the expected tubing remaining thickness, which is the difference between the original tubing thickness and the expected metal loss in the tubing. In other words, existing tubulars in the completion is de-rated considering the new expected thickness.

In Block 324, the de-rated (new) tubing burst/collapse ratings are compared against the well operating pressure envelop. In the case where the well operating pressure envelop does not exceed the de-rated tubing burst/collapse pressure, i.e., the new tubing burst/collapse ratings are not within the well operating pressure range, the descaling operation is selected as the optimum approach to address the corrosion deposits issue. In contrast where the well operating pressure envelop exceeds the de-rated tubing burst/collapse pressure, i.e., the new tubing burst/collapse ratings are within the well operating pressure range, the rig workover operation to replace the corroded tubing is selected as the optimum approach to address the corrosion deposits issue.

Embodiments may be implemented on a computing system. Any combination of mobile, desktop, server, router, switch, embedded device, or other types of hardware may be used. For example, as shown in FIG. 4A, the computing system (400) may include one or more computer processors (402), non-persistent storage (404) (e.g., volatile memory, such as random access memory (RAM), cache memory), persistent storage (406) (e.g., a hard disk, an optical drive such as a compact disk (CD) drive or digital versatile disk (DVD) drive, a flash memory, etc.), a communication interface (412) (e.g., Bluetooth interface, infrared interface, network interface, optical interface, etc.), and numerous other elements and functionalities.

The computer processor(s) (402) may be an integrated circuit for processing instructions. For example, the computer processor(s) may be one or more cores or micro-cores of a processor. The computing system (400) may also include one or more input devices (410), such as a touchscreen, keyboard, mouse, microphone, touchpad, electronic pen, or any other type of input device.

The communication interface (412) may include an integrated circuit for connecting the computing system (400) to a network (not shown) (e.g., a local area network (LAN), a wide area network (WAN) such as the Internet, mobile network, or any other type of network) and/or to another device, such as another computing device.

Further, the computing system (400) may include one or more output devices (408), such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) (402), non-persistent storage (404), and persistent storage (406). Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the disclosure.

The computing system (400) in FIG. 4A may be connected to or be a part of a network. For example, as shown in FIG. 4B, the network (420) may include multiple nodes (e.g., node X (422), node Y (424)). Each node may correspond to a computing system, such as the computing system shown in FIG. 4A, or a group of nodes combined may correspond to the computing system shown in FIG. 4A. By way of an example, embodiments of the disclosure may be implemented on a node of a distributed system that is connected to other nodes. By way of another example, embodiments of the disclosure may be implemented on a distributed computing system having multiple nodes, where each portion of the disclosure may be located on a different node within the distributed computing system. Further, one or more elements of the aforementioned computing system (400) may be located at a remote location and connected to the other elements over a network.

Although not shown in FIG. 4B, the node may correspond to a blade in a server chassis that is connected to other nodes via a backplane. By way of another example, the node may correspond to a server in a data center. By way of another example, the node may correspond to a computer processor or micro-core of a computer processor with shared memory and/or resources.

The nodes (for example, node X (422), node Y (424)) in the network (420) may be configured to provide services for a client device (426). For example, the nodes may be part of a cloud computing system. The nodes may include functionality to receive requests from the client device (426) and transmit responses to the client device (426). The client device (426) may be a computing system, such as the computing system shown in FIG. 4A. Further, the client device (426) may include or perform all or a portion of one or more embodiments of the disclosure.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. A method for performing a maintenance operation of a well in an oil/gas field, the method comprising:

identifying, based on a measured sequence of internal diameters of a tubular in the well with respect to longitudinal distances along the well, an extent of corrosion deposit in the tubular;

predicting, using a descaling model of the oil/gas field and based on the extent of corrosion deposit, expected descaling metal loss in the tubular of the well, wherein the descaling model correlates measured descaling metal loss in a reference tubular in a reference well with respect to a difference between a measured sequence of internal diameters of the reference tubular and an original internal diameter of the reference tubular, wherein the reference well is separate from the well;

calculating, based on the expected descaling metal loss, a tubular burst/collapse pressure for a predicted thickness of the tubular;

comparing the tubular burst/collapse pressure against a well operating pressure to generate a comparison result; and performing the maintenance operation of the well based on the comparison result.

2. The method of claim 1, further comprising:

performing a de-scaling treatment in the reference well, wherein the measured sequence of internal diameters of the reference tubular is generated prior to the de-scaling treatment;

measuring, subsequent to the de-scaling treatment in the reference well, a sequence of post-treatment internal diameters of the reference tubular with respect to the longitudinal distances along the reference well; and generating the descaling model based on the measured sequence of internal diameters of the reference tubular and the measured sequence of post-treatment internal diameters of the reference tubular.

3. The method of claim 2, said generating the descaling model comprises:

correlating a post-treatment tubular profile of the reference well with a pre-treatment tubular profile of the reference well, wherein the pre-treatment tubular profile comprises the difference between the measured sequence of internal diameters of the reference tubular and the original internal diameter of the reference tubular, and wherein the post-treatment tubular profile comprises a difference between the measured sequence of post-treatment internal diameters of the reference tubular and the original internal diameter of the reference tubular.

4. The method of claim 3, said generating the descaling model further comprises:

generating a trend between corrosion deposit build up and the measured descaling metal loss, wherein the corrosion deposit build up corresponds to the pre-treatment tubular profile, and wherein the measured descaling metal loss corresponds to the post-treatment tubular profile.

5. The method of claim 1, wherein the extent of corrosion deposit of the well corresponds to a difference between the measured sequence of internal diameters of the tubular and an original internal diameter of the tubular.

6. The method of claim 1, wherein the predicted thickness of the tubular is calculated by subtracting the expected descaling metal loss from an original tubular thickness.

7. The method of claim 1, said performing the maintenance operation comprises:

performing, based on the comparison result, a chemical descaling operation of the tubular.

8. The method of claim 7, wherein the comparison result indicates that the tubular burst/collapse pressure exceeds a maximum well operating pressure of the well.

9. The method of claim 1, said performing the maintenance operation comprises:

performing, based on the comparison result, a mechanical descaling operation of the tubular.

10. The method of claim 9, wherein the comparison result indicates that the tubular burst/collapse pressure exceeds a maximum well operating pressure of the well.

11. The method of claim 1, said performing the maintenance operation comprises:

performing, based on the comparison result, a replacement operation of the tubular.

12. The method of claim 11, wherein the comparison result indicates that the tubular burst/collapse pressure is less than a maximum well operating pressure of the well.

13. A system for performing a maintenance operation of a well in an oil/gas field, comprising:

a well control system for performing well maintenance operations of the well; and a well maintenance management system comprising:

a tubular profiling engine configured to identify, based on a measured sequence of internal diameters of a tubular in the well with respect to longitudinal distances along the well, an extent of corrosion deposit in the tubular;

a descaling modeling engine configured to:

generate a descaling model based on a reference well in the oil/gas field wherein the descaling model correlates measured descaling metal loss in a reference tubular in the reference well with respect to a difference between a measured sequence of internal diameters of the reference tubular and an original internal diameter of the reference tubular, wherein the reference well is separate from the well; and predict, using the descaling model and based on the extent of corrosion deposit, expected descaling metal loss in the tubular of the well; and a descaling management engine configured to:

calculate, based on the expected descaling metal loss, a tubular burst/collapse pressure for a predicted thickness of the tubular;

compare the tubular burst/collapse pressure against a well operating pressure to generate a comparison result; and facilitate, based on the comparison result, performing the maintenance operations of the well by the well control system.

14. The system of claim 13, said generating the descaling model comprises:

performing a de-scaling treatment in the reference well, wherein the measured sequence of internal diameters of the reference tubular is generated prior to the de-scaling treatment;

measuring, subsequent to the de-scaling treatment in the reference well, a sequence of post-treatment internal diameters of the reference tubular with respect to the longitudinal distances along the reference well; and correlating a post-treatment tubular profile of the reference well with a pre-treatment tubular profile of the reference well, wherein the pre-treatment tubular profile comprises the difference between the measured sequence of internal diameters of the reference tubular and the original internal diameter of the reference tubular, and wherein the post-treatment tubular profile comprises a difference between the measured sequence of post-treatment internal diameters of the reference tubular and the original internal diameter of the reference tubular.

15. The system of claim 14, said generating the descaling model further comprises:

generating a trend between corrosion deposit build up and the measured descaling metal loss, wherein the corrosion deposit build up corresponds to the pre-treatment tubular profile, and wherein the measured descaling metal loss corresponds to the post-treatment tubular profile.

16. The system of claim 13, wherein the extent of corrosion deposit of the well corresponds to a difference between the measured sequence of internal diameters of the tubular and an original internal diameter of the tubular.

17. The system of claim 13, wherein the predicted thickness of the tubular is calculated by subtracting the expected descaling metal loss from an original tubular thickness.

18. The system of claim 13, said performing the maintenance operation comprises:

performing, based on the comparison result, a chemical descaling operation of the tubular.

19. The system of claim 13, said performing the maintenance operation comprises:

performing, based on the comparison result, a mechanical descaling operation of the tubular.

20. The system of claim 13, said performing the maintenance operation comprises:

performing, based on the comparison result, a replacement operation of the tubular.

* * * * *